US008251722B2

(12) United States Patent
Tsai

(10) Patent No.: US 8,251,722 B2
(45) Date of Patent: Aug. 28, 2012

(54) ELECTRICAL CONNECTOR AND ONE PAIR OF SWITCH TERMINALS THEREOF

(76) Inventor: Horng Yu Tsai, SinJhuang (TW)

( * ) Notice: Subject to any disclaimer, the term of this patent is extended or adjusted under 35 U.S.C. 154(b) by 0 days.

(21) Appl. No.: 13/077,985

(22) Filed: Apr. 1, 2011

(65) Prior Publication Data

US 2011/0244701 A1 Oct. 6, 2011

(30) Foreign Application Priority Data

Apr. 2, 2010 (TW) ..... 99205966 U
Sep. 11, 2010 (TW) ..... 99217717 U

(51) Int. Cl.
*H01R 29/00* (2006.01)

(52) U.S. Cl. ..... 439/188

(58) Field of Classification Search ..... 439/188, 439/489, 630
See application file for complete search history.

(56) References Cited

U.S. PATENT DOCUMENTS 5,330,363 A * 7/1994 Gardner et al. ..... 439/188
5,334,827 A * 8/1994 Bleier et al. ..... 235/492
6,039,599 A * 3/2000 Benjamin et al. ..... 439/489
6,073,853 A * 6/2000 Odic ..... 235/486
6,126,464 A * 10/2000 Chang ..... 439/188
6,130,387 A * 10/2000 Bricaud et al. ..... 200/43.04
6,326,568 B2 * 12/2001 Martucci et al. ..... 200/283
6,399,906 B1 * 6/2002 Sato et al. ..... 200/61.59
6,638,087 B1 * 10/2003 Takada et al. ..... 439/188
6,719,577 B2 * 4/2004 Nogami ..... 439/188
6,749,450 B1 * 6/2004 Chen ..... 439/188
6,761,572 B1 * 7/2004 Chou ..... 439/188
6,830,474 B2 * 12/2004 Liu et al. ..... 439/489
6,848,923 B2 * 2/2005 Takada et al. ..... 439/188
6,899,557 B2 * 5/2005 Hirata ..... 439/188
6,957,983 B1 * 10/2005 Lai ..... 439/630
7,101,206 B2 * 9/2006 Chang ..... 439/188
7,318,734 B2 * 1/2008 Lee et al. ..... 439/188
7,435,117 B2 * 10/2008 Ma ..... 439/188
7,435,119 B2 * 10/2008 Chang et al. ..... 439/188
7,510,443 B2 * 3/2009 Ma ..... 439/630
7,563,138 B2 * 7/2009 Zhang et al. ..... 439/630
7,686,633 B2 * 3/2010 Yu et al. ..... 439/188
7,837,488 B2 * 11/2010 Wu ..... 439/188
7,938,656 B2 * 5/2011 Hu ..... 439/159
7,972,156 B2 * 7/2011 Zhou et al. ..... 439/188
2006/0079106 A1 * 4/2006 Kikuchi ..... 439/188

* cited by examiner

*Primary Examiner* — Amy Cohen Johnson
*Assistant Examiner* — Vladimir Imas
(74) *Attorney, Agent, or Firm* — Pro-Techtor Int'l Services

(57) ABSTRACT

An electrical connector includes a base, terminals each being disposed on the base and having a contact, and one pair of switch terminals, disposed on the base, including first and second terminals each having a fixing portion, a pin portion and an extension. The base has a connection slot for accommodating an electronic element. The first and second terminals have the fixing portions, each fixed to the base and having a plateless section. The extensions respectively have corresponding connection points. The extension of the first terminal has a pushing portion. The electronic element is inserted into the slot to push the pushing portion to make the extension of the first terminal be elastically moved to touch the switch terminals. Plate surfaces of the fixing portions are arranged in parallel or on the same plane and fixed to the base, and do not overlap with each other.

19 Claims, 17 Drawing Sheets

ELECTRICAL CONNECTOR AND ONE PAIR OF SWITCH TERMINALS THEREOF

BACKGROUND OF THE INVENTION

1. Field of the Invention

The invention relates in general to an electrical connector, and more particularly to an electrical connector having one pair of switch terminals.

2. Related Art

Referring to FIGS. 1 and 1A, a conventional smart card connector includes a plastic base 10, two rows of contact terminals 15 and one pair of switch terminals 20 and 26. The pair of switch terminals 20 and 26 are disposed at a rear end of the plastic base 10. The switch terminal 20 has a substantially inverse-L shape and has a fixing portion 21, an extension 22, a pin portion 23 on the same plane. A portion of the extension 22 near a tail end of the extension 22 is bent to form a pushing portion 24 and a connection point 25 projecting in opposite directions. The switch terminal 26 also has the substantially inverse-L shape and has a fixing portion 27, an extension 28, a pin portion 29 on the same plane. A portion near of the extension 28 near the tail end of the extension 28 is bent to form a projecting connection point 210. The connection points 210 and 25, which are disposed opposite each other and can approach each other, form a line extending from front to rear.

When a smart card is inserted into the plastic base 10, it pushes the pushing portion 24 of the switch terminal 20 to make the connection point 25 be in contact with the connection point 210.

In the structure of the pair of switch terminals 20 and 26, the fixing portion, the extension and the pin portion 23 are disposed on the same plane. So, two terminals cannot be formed into continuous terminals using a metal sheet by way of pressing according to a terminal gap, and the pair of switch terminals 20 and 26 only can be pressed in a dispersed manner, and respectively assembled to the plastic base 10 in a labor-consuming manner. In addition, the backward movement of the connection point 25 of the first terminal causes the connection point 25 to directly push the connection point 210 of the second terminal, and no wearing effect is produced.

SUMMARY OF THE INVENTION

It is therefore an object of the invention to provide an electrical connector and one pair of switch terminals thereof, wherein the pair of switch terminals are integrally formed of a metal sheet by way of pressing, and the pair of switch terminals have fixing portions, which are arranged on a plate surface, and the plate surfaces of the fixing portions of the pair of switch terminals do not overlap with each other.

The invention achieves the above-identified object by providing an electrical connector includes a base, terminals and one pair of switch terminals. The base has a connection slot for accommodating an electronic element. The terminals are disposed on the base, each of the terminals having a contact. The pair of switch terminals are disposed on the base and include a first terminal and a second terminal, each having a fixing portion, a pin portion and an extension. Each of the fixing portions of the first and second terminals is fixed to the base and has a plateless section, and the extensions of the first and second terminals respectively have connection points corresponding to each other. The extension of the first terminal has a pushing portion. The electronic element is inserted, from a front end of the base, into the connection slot to push the pushing portion to make the extension of the first terminal be elastically moved to touch the pair of switch terminals. The first and second terminals are made of a metal sheet by way of pressing, plate surfaces of the fixing portions of the first and second terminals are arranged in parallel or on the same plane and fixed to the base, and the plate surfaces of the fixing portions of the first and second terminals do not overlap with each other.

The first and second terminals are formed by pressing the same metal sheet, so that the first and second terminals may be pressed at a time, plated at a time and assembled to the base at a time, and the manufacturing processes may be simplified.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1A:
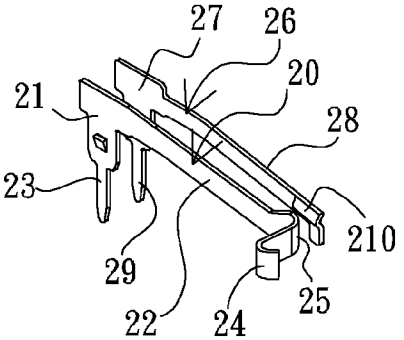
FIG. 1A (Prior Art)
FIG. 1A is a pictorial view showing one pair of switch terminals of the conventional electrical connector.
Figure 1:
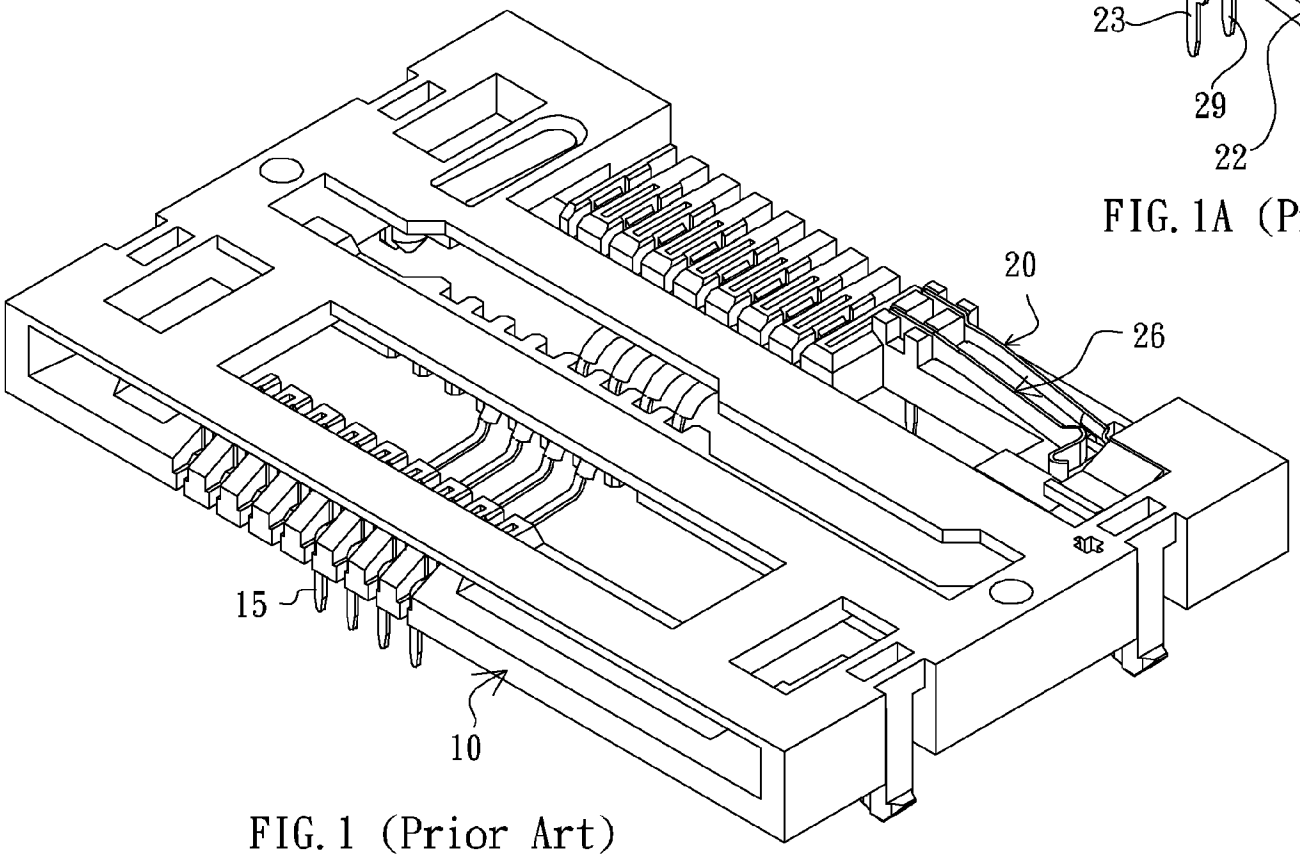
FIG. 1 (Prior Art)
FIG. 1 is a pictorial view showing a conventional electrical connector.
Figure 2:
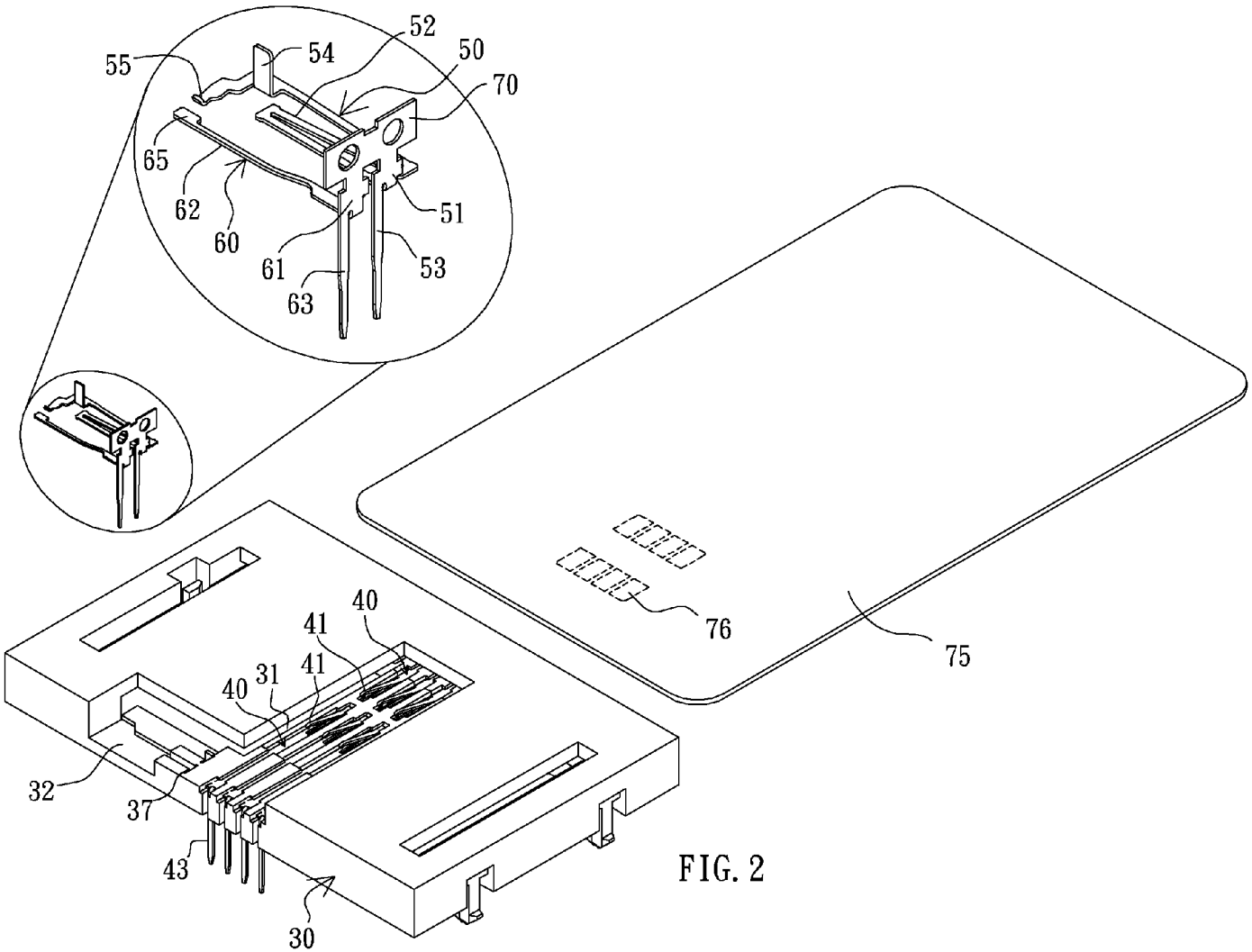
FIG. 2 is a pictorially exploded view showing a first embodiment of the invention.
Figures 3, 4:
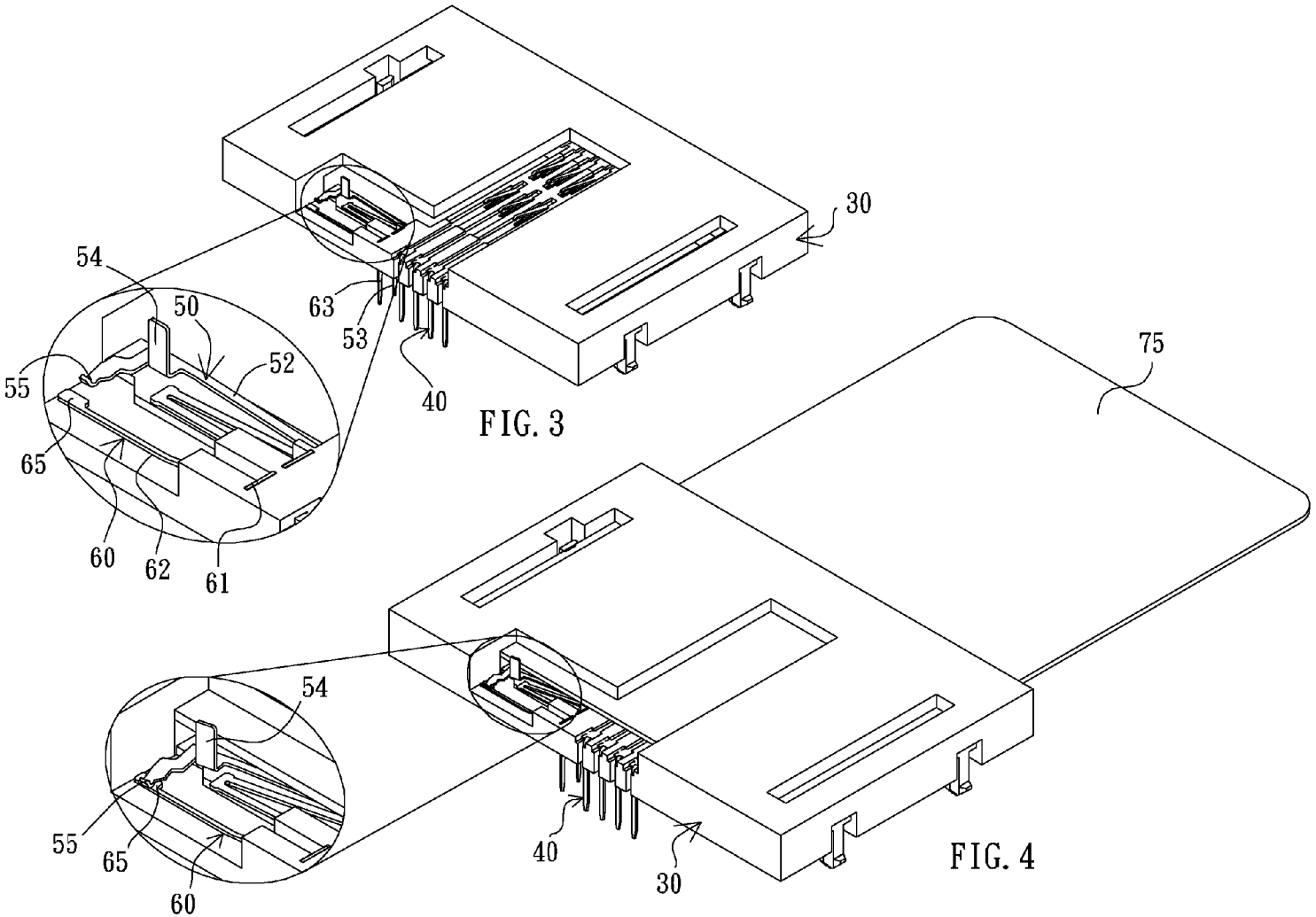
FIG. 3 is a pictorially assembled view showing the first embodiment of the invention.
FIG. 4 shows the used state of the first embodiment of the invention.

Referring to FIGS. 2 and 3, a smart card connector according to a first embodiment of the invention includes a base 30, two rows of terminals 40 and one pair of switch terminals.

The base 30 has a connection slot 31, which can accommodate a smart card 75. One surface of the smart card 75 has two rows of connection points 76 aligned in the front-to-rear direction. A rear end on one side of the base is formed with a switch terminal slot 32 and two longitudinal slots 37.

The two rows of contact terminals 40 are disposed on the base 30. Each contact terminal 40 has a contact 41 and a pin portion 43. The contacts 41 of the two rows of contact terminals 40 correspond to one another in the front-to-rear direction. When the smart card 75 is inserted into the connection slot, the two rows of connection points 76 of the smart card aligned in the front-to-rear direction are electrically connected to the contacts 41 of the two rows of contact terminals 40.

The pair of switch terminals are disposed in the switch terminal slot 32 of the base and includes a first terminal 50 and a second terminal 60.

Figure 5:
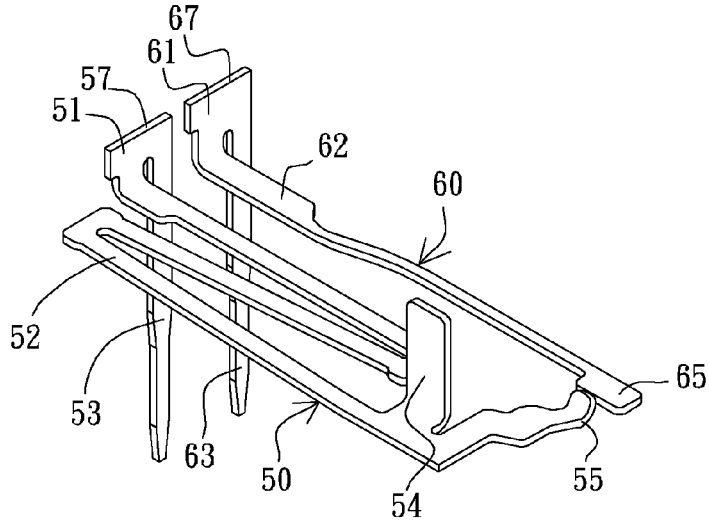
FIG. 5 is a pictorial view showing one pair of switch terminals assembled to a base according to the first embodiment of the invention.

As shown in FIG. 5, the first terminal 50 has a fixing portion 51, an extension 52 and a pin portion 53. The fixing portion 51 has a longitudinal plate surface fixed to the longitudinal slot 37 of the base 30, and the top end of the fixing portion 51 has a plateless section 57. The extension 52 is perpendicular to and connected to the fixing portion 51, extends horizontally and substantially has an N-shape. A portion of the extension 52 near a tail end of the extension 52 has a longitudinally projecting pushing portion 54 and a downwardly projecting connection point 55. At least one side of the connection point 55 is formed with an inclined guiding surface. The pin portion 53 is connected to a bottom end of the fixing portion 51, and the pin portion 53 and the fixing portion 51 are disposed on the same plane.

The second terminal 60 has a fixing portion 61, an extension 62 and a pin portion 63. The fixing portion 61 has a longitudinal plate surface fixed to the longitudinal slot 37 of the base 30. A top end of the fixing portion 61 has a plateless section 67. The extension 62 and the fixing portion 61 are perpendicular to and connected to each other and the extension 62 extends horizontally. A portion of the extension 62 near a tail end of the extension has an upward connection point 65. The pin portion 53 is connected to the bottom end of the fixing portion 51, and the pin portion 53 and the fixing portion 51 are disposed on the same plane.

The first and second terminals 50 and 60 are manufactured by pressing the same metal sheet and are plated. After being pressed and plated, the plateless sections 57 and 67 of the top ends of the fixing portions of the first and second terminals 50 and 60 are connected to a material tape 70. The first and second terminals 50 and 60 are together assembled, from top to bottom, to the base 30 and then the material tape 70 is broken. After being assembled to the base 30, plate surfaces (the larger surfaces) of the fixing portions 51 and 61 of the first and second terminals 50 and 60 are arranged in parallel or on the same plane, and do not overlap with each other. The plateless sections 57 and 67 are flush with each other and located at the same height or level. The plate surfaces of the ends of the fixing portions 51 and 61 are flush with each other and are disposed on the same plane. The connection point 55 of the first terminal is separated from the connection point 65 of the second terminal 60, so that the connection points 55 and 65 are in a normally-opened state. The fixing portions 51 and 61 and the pin portions 53 and 63 of the first and second terminals 50 and 60 are arranged in a front-to-rear manner.

Figure 6:
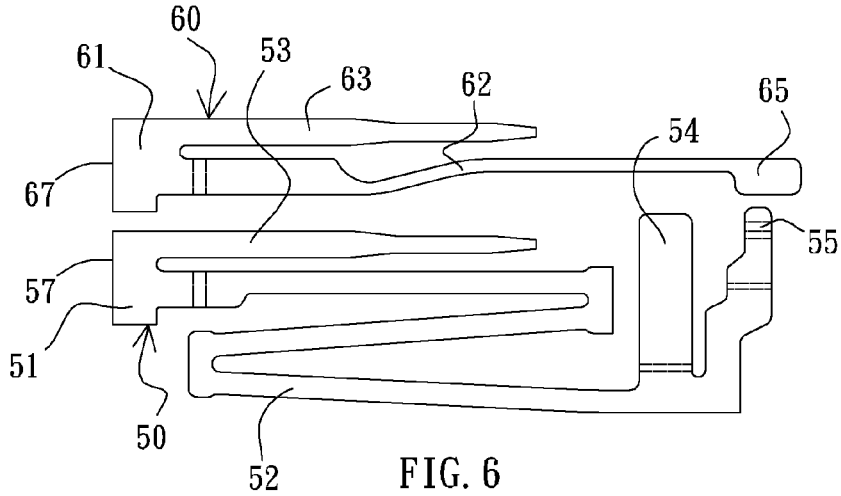
FIG. 6 is a developed plane view showing the pair of switch terminals according to the first embodiment of the invention at the position of FIG. 5.
Figure 7:
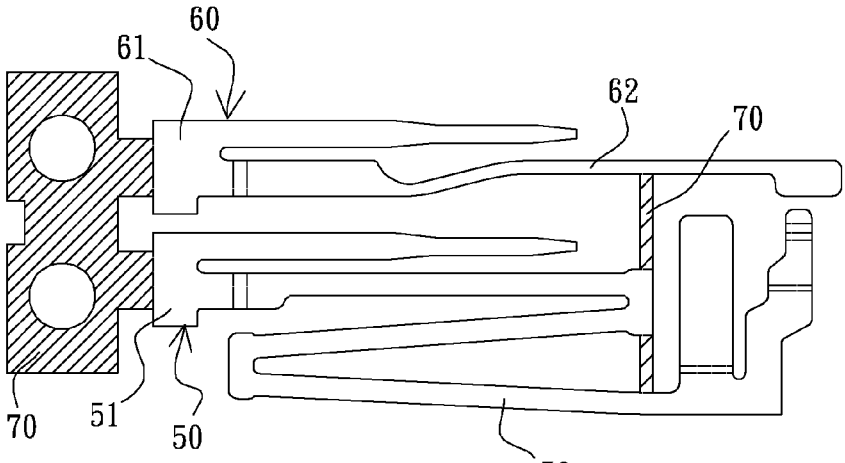
FIG. 7 is a developed plane view showing the pair of switch terminals connected to a material tape at the position of FIG. 5 according to the first embodiment of the invention.

FIG. 6 is a developed plane view showing that the first and second terminals 50 and 60 of FIG. 5 are assembled to the base 30 and then the plateless sections 57 and 67 of the two terminals are flush with each other and located at the same height. In this case, the first and second terminals 50 and 60 do not overlap with each other, so that they can be formed by pressing the same metal sheet. Please refer to FIG. 7, in which the hatched portion represents the material tapes 70 and 71 connected together.

The first and second terminals 50 and 60 are formed by pressing the same metal sheet, so that the first and second terminals 50 and 60 may be pressed at a time, plated at a time and assembled to the base at a time, and the manufacturing processes may be simplified.

As shown in FIG. 4, when the smart card 75 is inserted into the connection slot 31 from the front end of the base, the inserting direction of the smart card 75 is parallel to the plate surfaces of the fixing portions 51 and 61 of the first and second terminals. The smart card 75 pushes the pushing portion 54 to elastically move the extension 52 of the first terminal 50 backwards, so that the connection point 55 of the first terminal is moved backwards to contact with the connection point 65 of the second terminal 60 in the top-to-bottom direction. The movement of the connection point 55 of the first terminal on the connection point 65 of the second terminal 60 can produce wear to scratch the oxide layer.

Figures 8, 9:
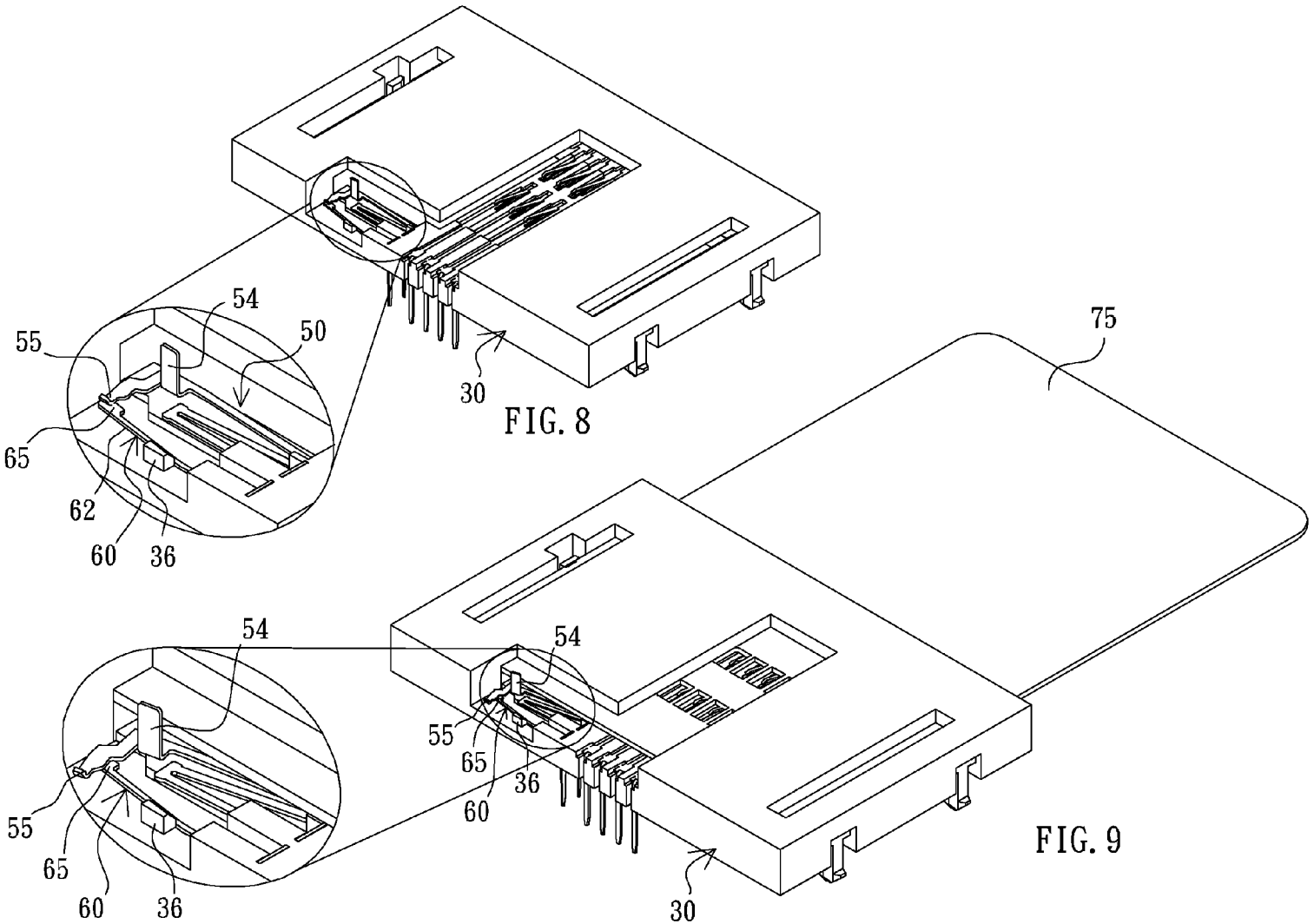
FIG. 8 is a pictorially assembled view showing a second embodiment of the invention.
FIG. 9 shows the used state of the second embodiment of the invention.

As shown in FIG. 8, the second embodiment of the invention is almost the same as the first embodiment except that this embodiment pertains to the normally-closed embodiment. That is, the base 30 has a projection 36 urging the extension 62 of the second terminal 60 towards the first terminal 50 slightly, so that the connection points 55 and 65 of the first and second terminals elastically contact with each other in the top-to-bottom direction. As shown in FIG. 9, when the pushing portion 54 of the first terminal is pressed by the smart card 75, the connection points 55 and 65 of the first and second terminals enter the separated state.

Figure 10:
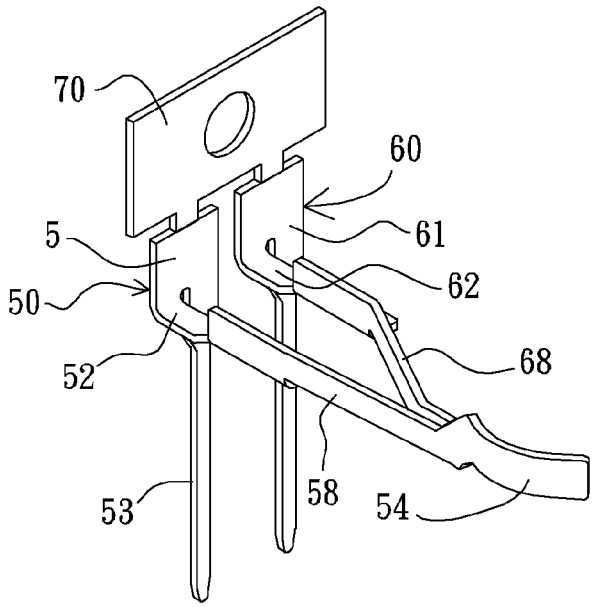
FIG. 10 is a pictorial view showing one pair of switch terminals according to a third embodiment of the invention.
Figure 11:
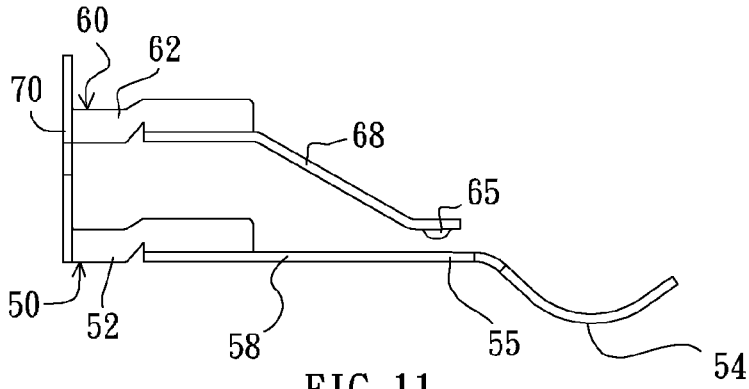
FIG. 11 is a top view showing the pair of switch terminals according to the third embodiment of the invention.

As shown in FIGS. 10 and 11, the third embodiment of the invention pertains to the normally-opened embodiment, which is almost the same as the first embodiment except that the extension 52 of the first terminal 50 of this embodiment has a longitudinal plate surface 58. A portion of the longitudinal plate surface 58 near a tail end thereof has a frontwardly projecting pushing portion 54, and the middle section of the longitudinal plate surface 58 has a connection point 55 with a plate surface facing backwards. The extension 62 of the second terminal 60 also has a longitudinal plate surface 68. The longitudinal plate surface 68 has a frontwardly projecting pushing portion 65 and a connection point 65 with a plate surface facing frontward. The connection point 55 of the first terminal 50 and the connection point 65 of the second terminal 60 face each other in the front-to-rear direction.

Figure 12:
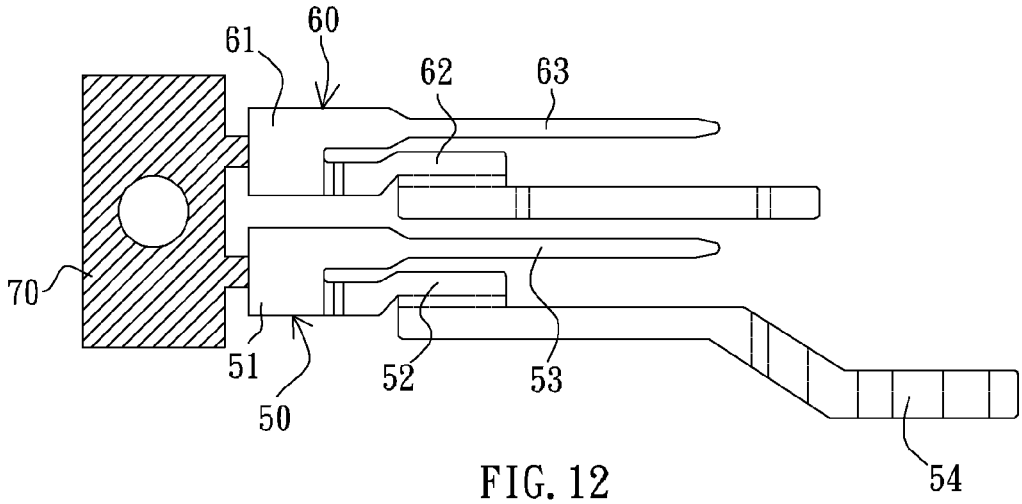
FIG. 12 is a developed plane view showing the pair of switch terminals according to the third embodiment of the invention.

As shown in FIG. 12, in which the first and second terminals 50 and 60 together with the material tape 70 of this embodiment are developed into a plane view, the first and second terminals 50 and 60 do not overlap with each other, so that the first and second terminals can be formed by pressing the same metal sheet.

Figure 13:
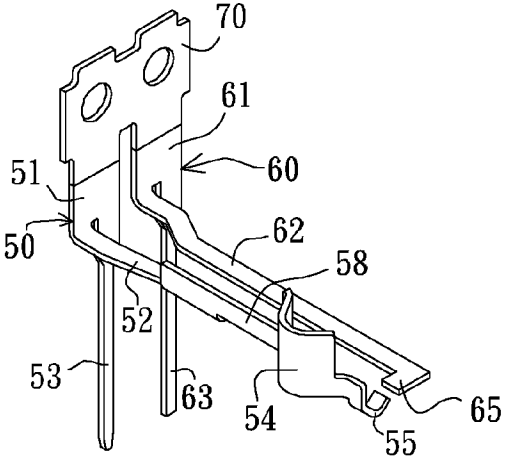
FIG. 13 is a pictorial view showing one pair of switch terminals according to a fourth embodiment of the invention.
Figure 14:
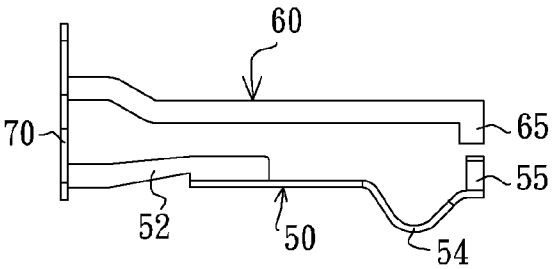
FIG. 14 is a top view showing the pair of switch terminals according to the fourth embodiment of the invention.

As shown in FIGS. 13 and 14, the fourth embodiment of this invention pertains to the normally-opened embodiment, and is almost the same as the first and third embodiments except that the extension 52 of the first terminal 50 of this embodiment has a longitudinal plate surface 58. A portion of the longitudinal plate surface 58 near a tail end thereof has a frontwardly projecting pushing portion 54. The tail end of the longitudinal plate surface 58 is bent to form a connection point 55 with a plate surface projecting downwards.

Figure 15:
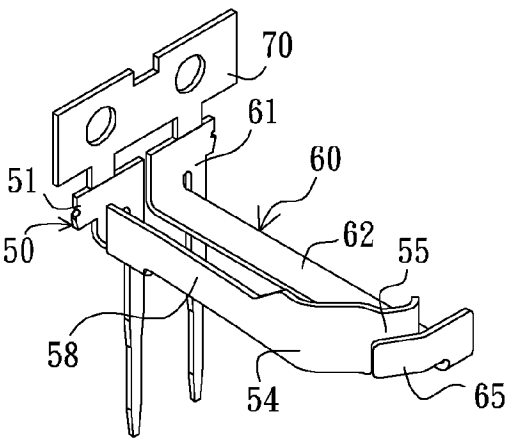
FIG. 15 is a pictorial view showing one pair of switch terminals according to a fifth embodiment of the invention.
Figure 16:
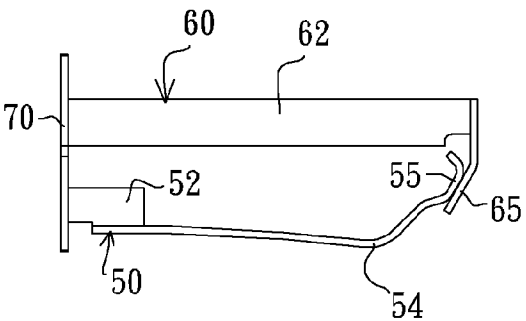
FIG. 16 is a top view showing the pair of switch terminals according to the fifth embodiment of the invention.

As shown in FIGS. 15 and 16, the fifth embodiment of the invention pertains to the normally-closed embodiment and is almost the same as the third embodiment except that the extension 52 of the first terminal 50 of this embodiment has a longitudinal plate surface 58. A portion of the longitudinal plate surface 58 near a tail end thereof has a frontwardly projecting pushing portion 54, and the tail end of the longitudinal plate surface 58 has a longitudinal connection point 55. The tail end of the extension 62 of the second terminal 60 is bent into a connection point 65, which has a longitudinal plate surface and elastically presses against the connection point 55 of the first terminal 50.

Figure 17:
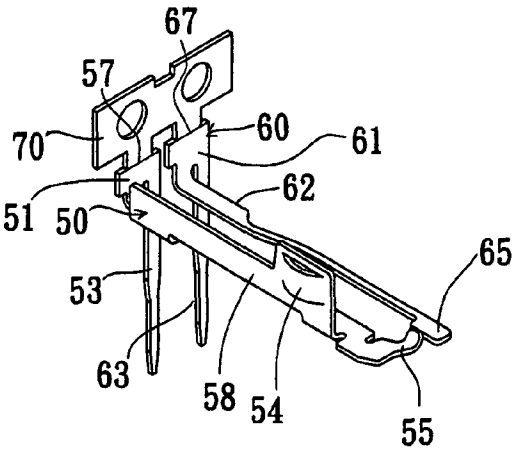
FIG. 17 is a pictorial view showing one pair of switch terminals according to a sixth embodiment of the invention.
Figure 18:
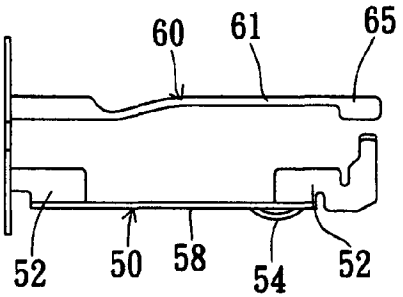
FIG. 18 is a top view showing the pair of switch terminals according to the sixth embodiment of the invention.
Figure 19:
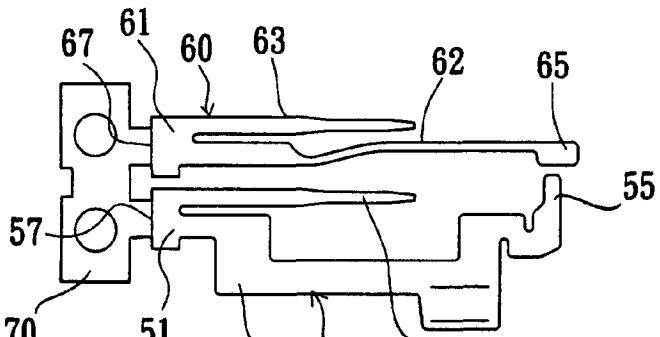
FIG. 19 is a developed plane view showing the pair of switch terminals according to the sixth embodiment of the invention.

FIGS. 17 to 19 show the sixth embodiment of the invention, which is a normally-opened embodiment and is almost the same as the fourth embodiment except that the head and tail sections of the extension 52 of the first terminal 50 of this embodiment are the horizontal plate surfaces, and the middle section of the extension 52 is the longitudinal plate surface 58. The longitudinal plate surface 58 is prodded to form a frontwardly projecting pushing portion 54, and the horizontal plate surface of the tail section has a downwardly projecting connection point 55 near the connection point 65 of the second terminal 60. The outer side of the connection point 55 has the inclined guiding surface, so that the connection point 55 of the first terminal 50 contacts with the connection point 65 of the second terminal 60 in the top-to-bottom direction when the extension 52 of the first terminal 50 is elastically moved backwards.

Similarly, the first and second terminals 50 and 60 are formed by pressing a metal sheet, each of the fixing portions 51 and 61 of the first and second terminals has a plateless section 57/67 connected to the material tape 70. When the plateless sections 57 and 67 of the fixing portions of the first and second terminals are flush with each other and the first and second terminals 50 and 60 are developed on the same plane, the first and second terminals do not overlap with each other.

Figure 20:
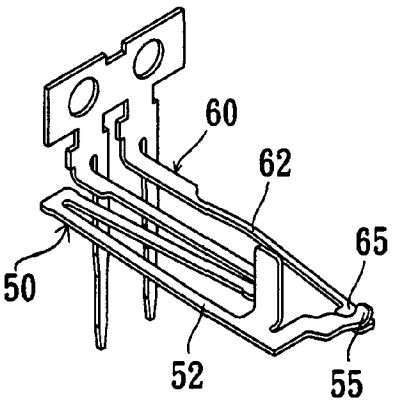
FIG. 20 is a pictorial view showing one pair of switch terminals according to a seventh embodiment of the invention.

As shown in FIG. 20, the seventh embodiment of the invention pertains to the normally-closed embodiment and is almost the same as the first embodiment except that the extension 62 of the second terminal 60 is again machined and bent toward the first terminal 50 after the first and second terminals 50 and 60 of this embodiment are formed by way of pressing, so that the connection points 55 and 65 of the first and second terminals elastically contact with each other.

Figure 22:
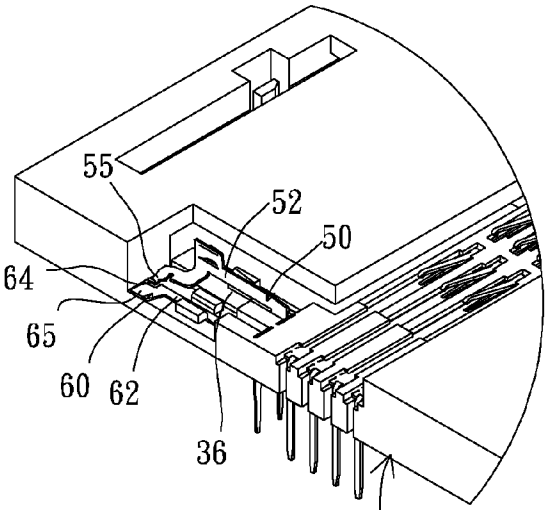
FIG. 22 is a pictorially assembled view showing the eighth embodiment of the invention.
Figure 21:
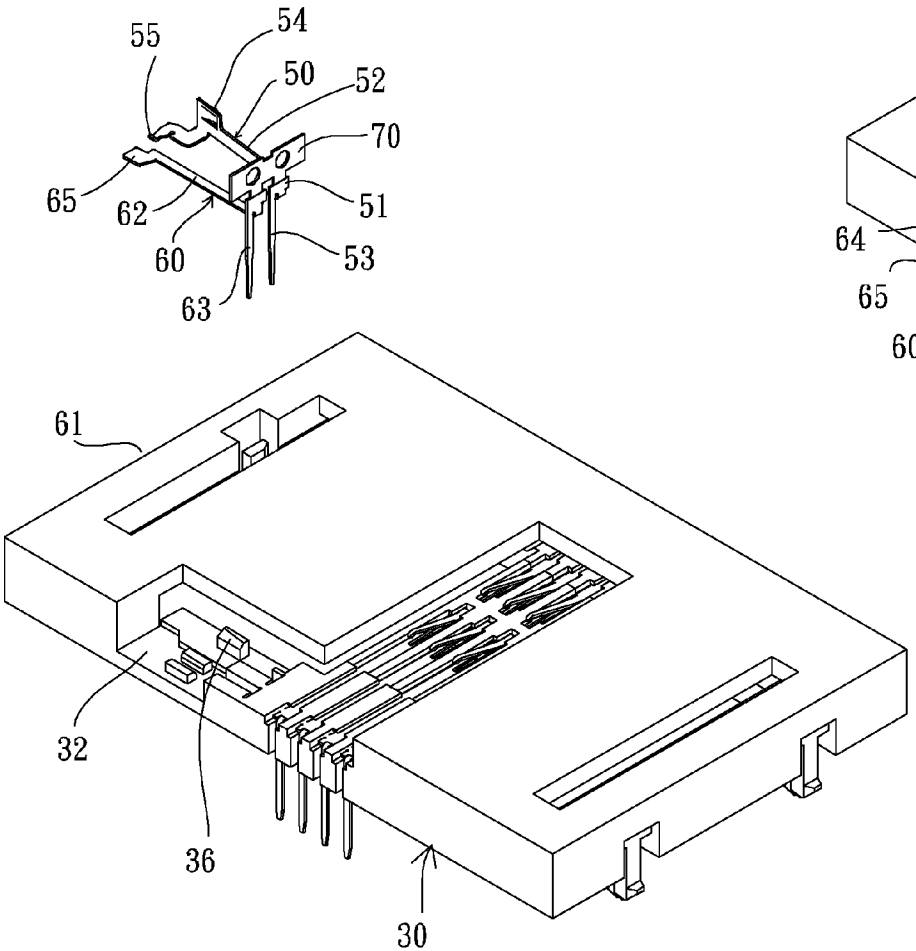
FIG. 21 is a pictorially exploded view showing an eighth embodiment of the invention.

As shown in FIGS. 21 and 22, the eighth embodiment of this invention pertains to a normally-opened embodiment and is almost the same as the sixth embodiment except that the extension 52 of the first terminal 50 slightly extends outwardly and slantingly after the first and second terminals 50 and 60 of this embodiment are formed by way of pressing. The switch terminal slot 32 of the base 30 has a projection 36 urging the extension 52 of the first terminal 50 toward the second terminal 60, so that the extension 52 of the first terminal has the flexibility for the excess pressure.

Figure 23:
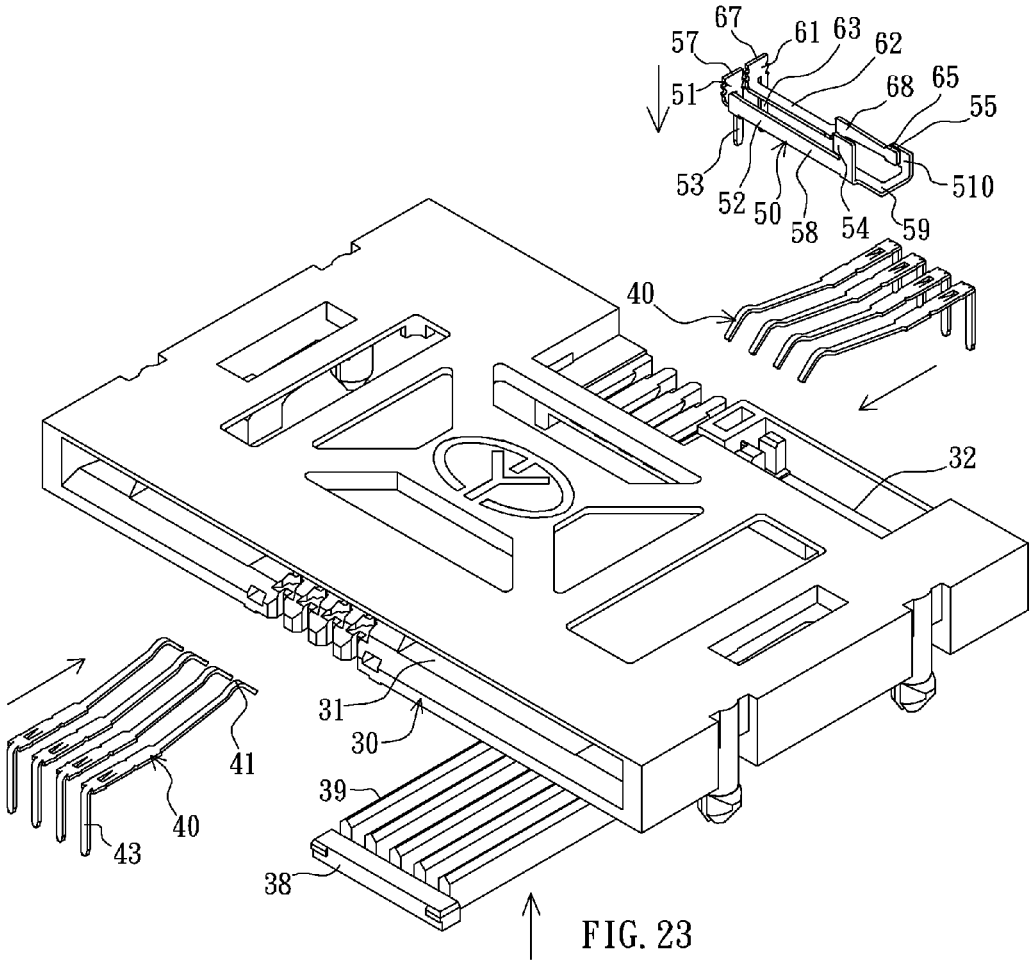
FIG. 23 is a pictorially exploded view showing a ninth embodiment of the invention.
Figure 24:
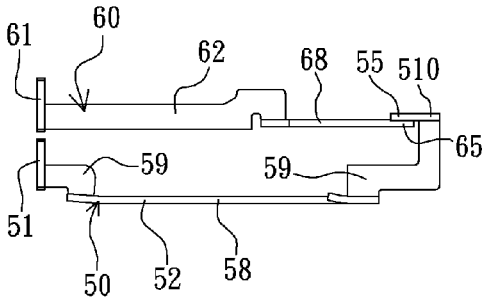
FIG. 24 is a top view showing one pair of switch terminals according to the ninth embodiment of the invention.

As shown in FIGS. 23 and 24, the smart card connector according to the ninth embodiment of this invention pertains to the normally-closed connector, which includes a base 30, two rows of terminals 40 and one pair of switch terminals.

The base 30 is integrally formed with a connection slot 31 for accommodating a smart card. The rear end on one side of the top of the base is formed with a switch terminal slot 32. In addition, a cover plate 38 covers the bottom surface of the base, and the cover plate 38 is formed with multiple longitudinal partition sheets 39.

The two rows of contact terminals 40 are disposed on the base 30. Each contact terminal 40 has a contact 41 and a pin portion 43. The contacts 41 of the two rows of contact terminals 40 correspond to each other in the front-to-rear direction.

When a smart card is inserted into the connection slot, the connection points of the two rows of terminals of the smart card aligned in the front-to-rear direction are electrically connected to the contacts 41 of the two rows of contact terminals 40.

The pair of switch terminals are disposed in the switch terminal slot 32 of the base from top to bottom and include a first terminal 50 and a second terminal 60. The first terminal 50 has a fixing portion 51, an extension 52 and a pin portion 53. The plate surface of the fixing portion 51 is longitudinally fixed to the base 30 and the top end of the fixing portion 51 has a plateless section 57. The head/tail section of the extension 52 is a horizontal plate surface 59, and the middle section of the extension 52 is a longitudinal plate surface 58. The horizontal plate surface 59 of the head section is perpendicular to the fixing portion 51, and the longitudinal plate surface 58 of the middle section has a pushing portion 54. The horizontal plate surface 59 of the tail section extends toward the second terminal 60 and is connected to another longitudinal plate surface 510. The longitudinal plate surface 510 has a connection point 55. The pin portion 53 is connected to the bottom end of the fixing portion 51, and the pin portion 53 and the fixing portion 51 are disposed on the same plane.

The second terminal 60 has a fixing portion 61, an extension 62 and a pin portion 63. The plate surface of the fixing portion 61 is longitudinally fixed to a longitudinal slot 37 of the base 30, and the top end of the fixing portion 61 has a plateless section 67. The extension 62 and the fixing portion 61 are perpendicular to and connected to each other, and extend horizontally. The tail section thereof has a longitudinal plate surface 68. The longitudinal plate surface 68 has a connection point 65. The pin portion 53 is connected to the bottom end of the fixing portion 51 and the pin portion 53 and the fixing portion 51 are disposed on the same plane. The connection points 55 and 65 of the first and second terminals are longitudinal and contact with each other in the front-to-rear direction.

After the first and second terminals 50 and 60 are assembled to the base 30, the plate surfaces of the fixing portions of the first and second terminals 50 and 60 are arranged in parallel or on the same plane and do not overlap with each other.

Figure 25:
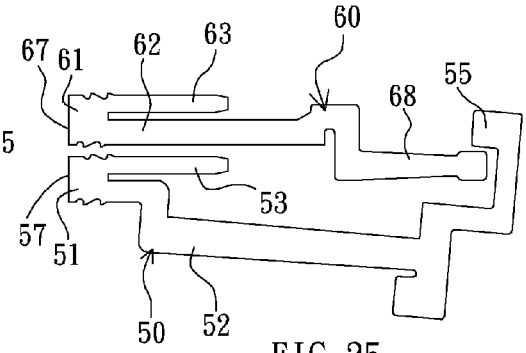
FIG. 25 is a developed plane view showing the pair of switch terminals according to the ninth embodiment of the invention.

Similarly, the first and second terminals 50 and 60 are formed by pressing a metal sheet. Each of the fixing portions 51 and 61 of the first and second terminals has a plateless section 57/67 connected to a material tape, as shown in FIG. 25. When the plateless sections 57 and 67 of the fixing portions of the first and second terminals are flush with each other and the first and second terminals 50 and 60 are developed on the same plane, the first and second terminals do not overlap with each other.

Figure 27:
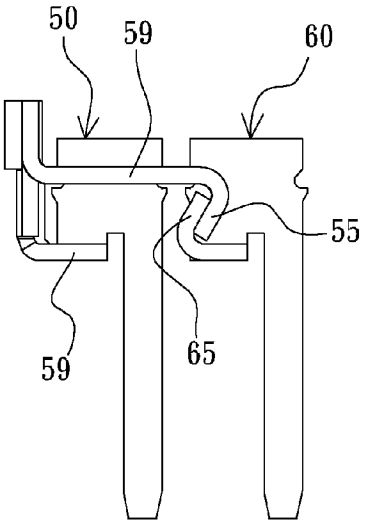
FIG. 27 is a side view showing the pair of switch terminals according to the tenth embodiment of the invention.
Figure 26:
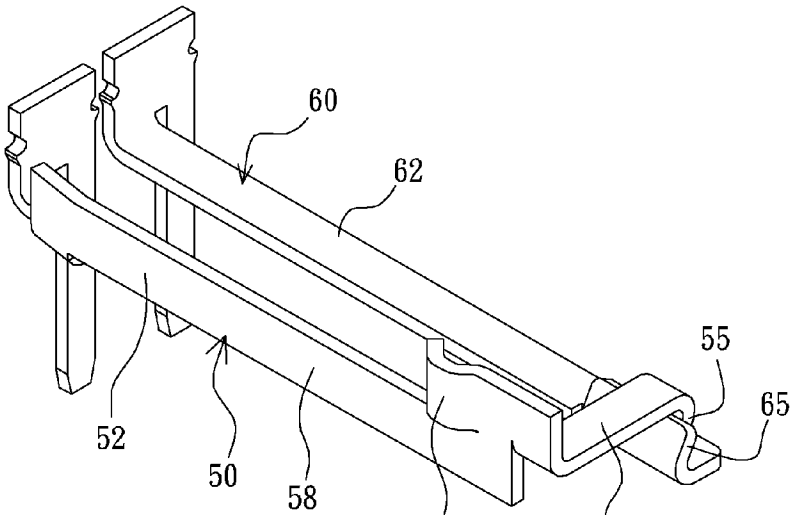
FIG. 26 is a pictorial view showing one pair of switch terminals according to a tenth embodiment of the invention.
Figure 28:
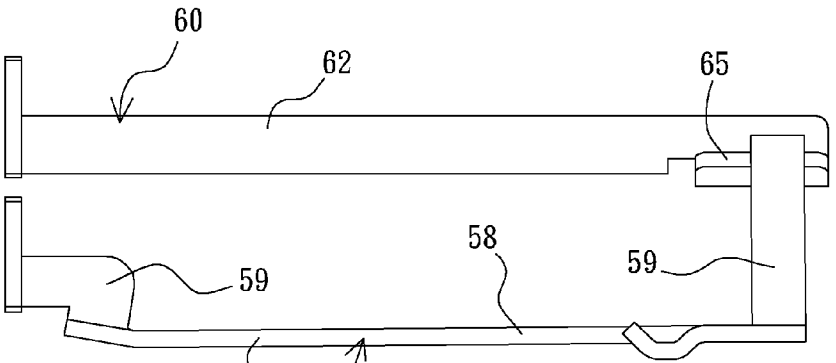
FIG. 28 is a top view showing the pair of switch terminals according to the tenth embodiment of the invention.

FIGS. 26 to 28 show the tenth embodiment of the invention, which pertains to the normally-closed embodiment and is almost the same as the ninth embodiment except that the horizontal plate surface 59 of the tail section of the extension 52 of the first terminal 50 of this embodiment is higher than the head section. The horizontal plate surface 59 of the tail section of the extension 52 extends toward the second terminal 60 and is bent downwardly to form a connection point 55. The connection point 55 is an inclined, longitudinal plate surface. The tail section of the extension 62 of the second terminal 60 is bent upwardly to form a connection point 65. The connection point 65 is also in the form of an inclined, longitudinal plate surface. The connection points 55 and 65 of the first and second terminals have the inclined surface contact in the front-to-rear direction.

Figures 29, 30:
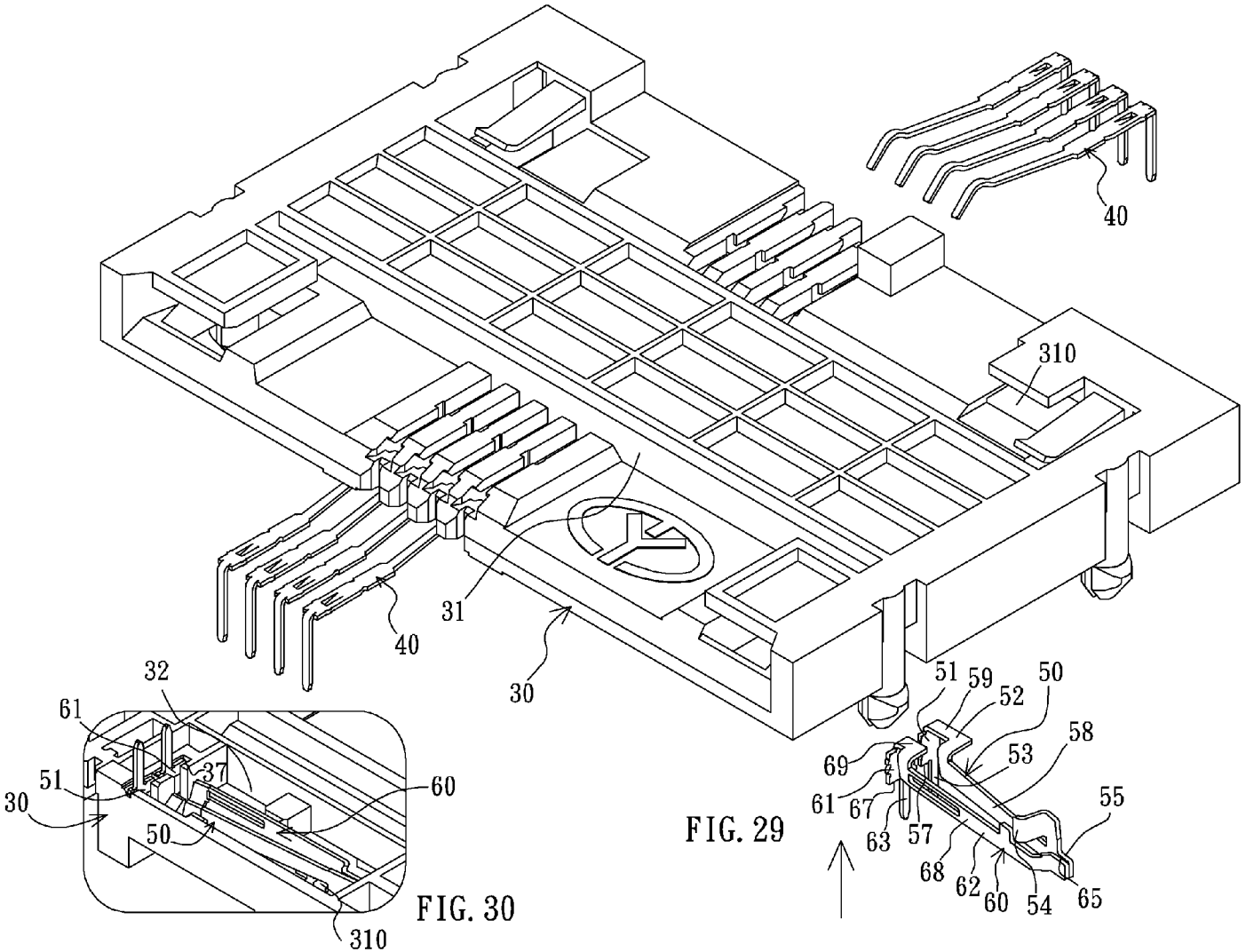
FIG. 29 is a pictorially exploded view showing an eleventh embodiment of the invention.
FIG. 30 is a pictorially assembled view showing a backside according to the eleventh embodiment of the invention.

FIGS. 29 and 30 show the eleventh embodiment of the invention, which pertains to the normally-closed embodiment and is almost the same as the ninth embodiment except that the switch terminal slot 32 and the two longitudinal slots 37 of this embodiment are disposed under the base. The inlet of the switch terminal slot faces downwards and has an opening communicating with the connection slot. The insert ports of the two longitudinal slots 38 face downwards. The first and second terminals 50 and 60 are disposed, from bottom to top, in the switch terminal slot 32 of the base 30. The fixing portions 51 and 61 engage with the two longitudinal slots 37. The extension 52 of the first terminal 50 is connected to the top end of the fixing portion 51. The middle of the bottom end of the fixing portion 51 is connected to the pin portion 53, and the fixing portion 51 has two sides formed with plateless sections 57 (the cut-off surfaces formed after the material tape is broken). The head section of the extension 52 is the horizontal plate surface 59 connected to and perpendicular to the fixing portion 51. The tail section of the extension 52 is the longitudinal plate surface 58. The tail end of the longitudinal plate surface 58 has a pushing portion 54 and a connection point 55. The pushing portion 54 is higher than the connection point 55 and extends from the opening 310 to the connection slot 31 and frontwardly projects to the front of the second terminal 60. The extension 62 of the second terminal 60 is also connected to the top end of the fixing portion 61. The middle of the bottom end of the fixing portion 61 is connected to the pin portion 63, and two sides of the fixing portion 61 are formed with plateless sections 67. The head section of the extension 62 is the horizontal plate surface 69 connected to and perpendicular to the fixing portion 61. The tail section of the extension 62 is the longitudinal plate surface 68. The tail end of the longitudinal plate surface 68 has a connection point 55. The connection points 55 and 65 of the first and second terminals are longitudinal and contact with each other in the front-to-rear direction.

The first and second terminals 50 and 60 are disposed in the switch terminal slot 32 under the base 30. The tops of the first and second terminals 50 and 60 have the good shield so that the dust cannot be easily accumulated thereon after a long term of use.

Figure 32:
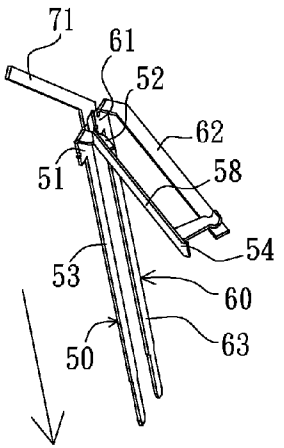
FIG. 32 is a pictorially assembled view showing the twelfth embodiment of the invention.
Figure 32:
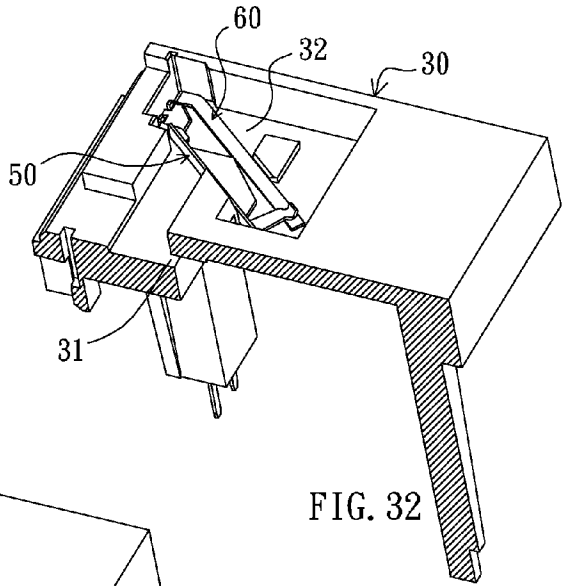
Figure 31:
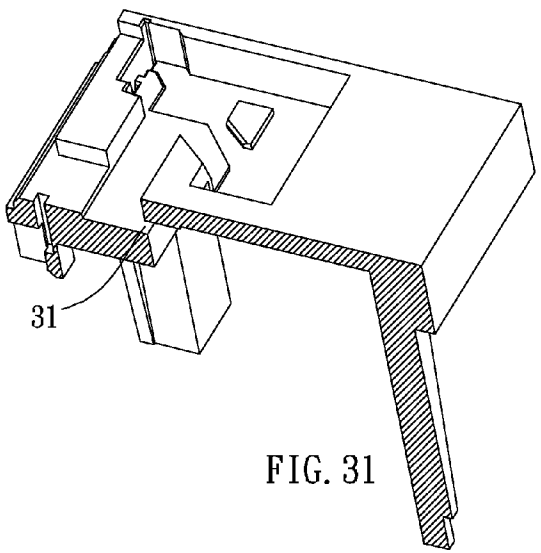
FIG. 31 is a pictorially exploded view showing a twelfth embodiment of the invention.
Figure 33:
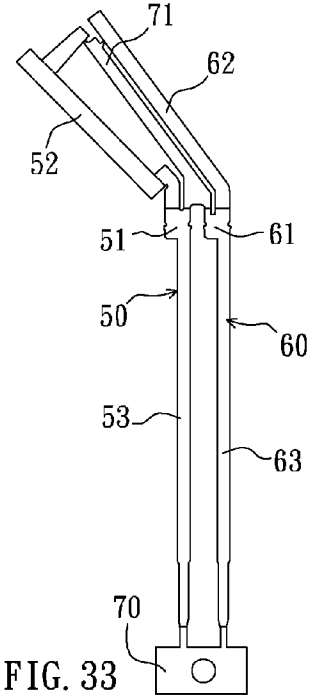
FIG. 33 is a developed plane view showing one pair of switch terminals according to the twelfth embodiment of the invention.

As shown in FIGS. 31 to 33, the twelfth embodiment of the invention pertains to the normally-closed embodiment and is almost the same as the second embodiment and the sixth embodiment except that the base 30 of this embodiment pertains to the elevated type and the connection slot 31 has the longer length, which means that the smart card is inserted more deeply. The tail end of the longitudinal plate surface 58 of the extension 52 of the first terminal 50 has the pushing portion 54. The extensions 52 and 62 of the first and second terminals 50 and 60 extend in the inclined, forward, horizontal direction, so that the pushing portion 54 of the first terminal 50 may be less extended to the frontward position in the inclined manner.

Similarly, the first and second terminals 50 and 60 are formed by pressing the same metal sheet. When the first and second terminals 50 and 60 are developed on the same plane, the first and second terminals do not overlap with each other. After pressing, the fixing portions 51 and 61 and the pin portions 53 and 63 of the first and second terminals are connected to the material tapes 70 and 71. When they are to be assembled to the base, the material tape 70 connected to the pin portions 53 and 63 is cut away, and the material tape 71 connected to the fixing portions 51 and 61 is utilized to install the first and second terminals 50 and 60 into the base 30 concurrently. Finally, the material tape 71 is broken.

Figure 34:
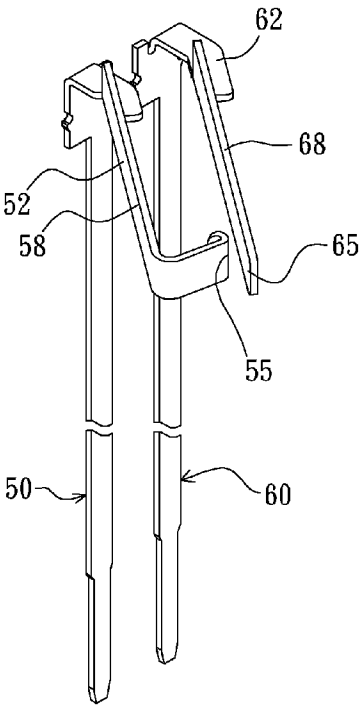
FIG. 34 is a pictorial view showing one pair of switch terminals according to a thirteenth embodiment of the invention.

As shown in FIG. 34, the thirteenth embodiment of the invention pertains to the normally-opened embodiment and is almost the same as the twelfth embodiment except that the tail section of the extension of the second terminal 60 of this embodiment has the longitudinal plate surface 68. A portion of the longitudinal plate surface 68 near the tail end thereof has the connection point 65. The longitudinal plate surface 58 of the extension 52 of the first terminal 50 is bent toward the second terminal 60 to form the connection point 55. The connection points 55 and 65 of the first and second terminals are longitudinal and contact with each other in the front-to-rear direction.

Figure 35:
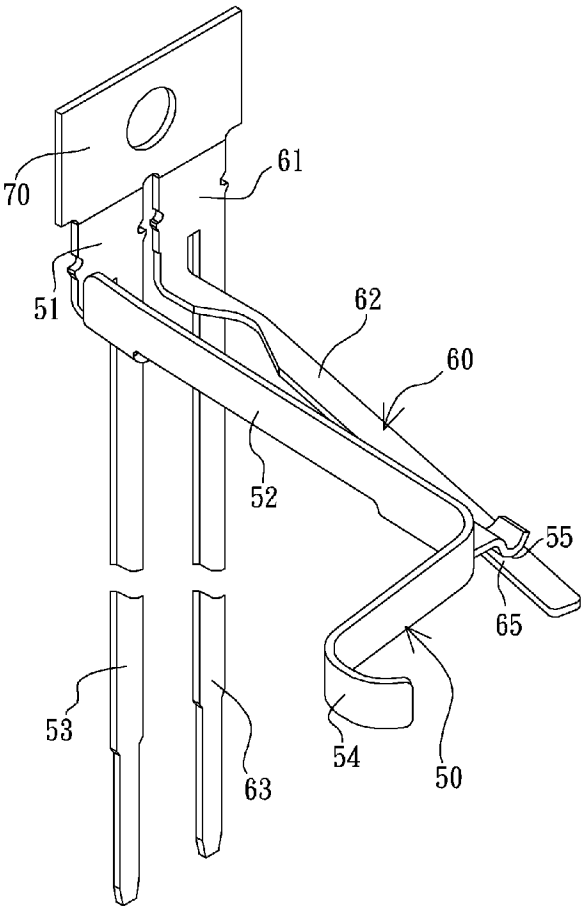
FIG. 35 is a pictorial view showing one pair of switch terminals according to a fourteenth embodiment of the invention.

As shown in FIG. 35, the fourteenth embodiment of the invention pertains to the normally-closed embodiment and is almost the same as the twelfth embodiment except that the first and second terminals 50 and 60 of this embodiment are formed by pressing the same metal sheet. After pressing, the top ends of the fixing portions 51 and 61 are connected to the material tape 70. In addition, the frontward tilt angles of the extensions 52 and 62 of the first and second terminals 50 and 60 are smaller than those of the twelfth embodiment. Thus, the pushing portion 54 of the first terminal 50 must frontwardly project by a length.

Figure 36:
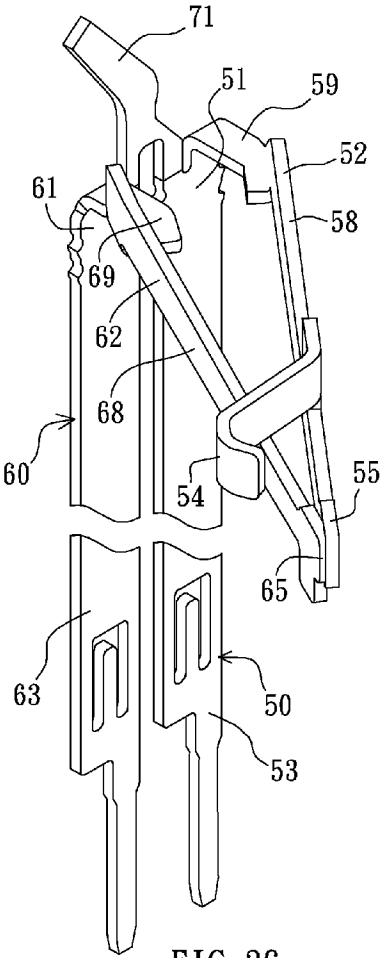
FIG. 36 is a pictorial view showing one pair of switch terminals according to a fifteenth embodiment of the invention.
Figure 37:
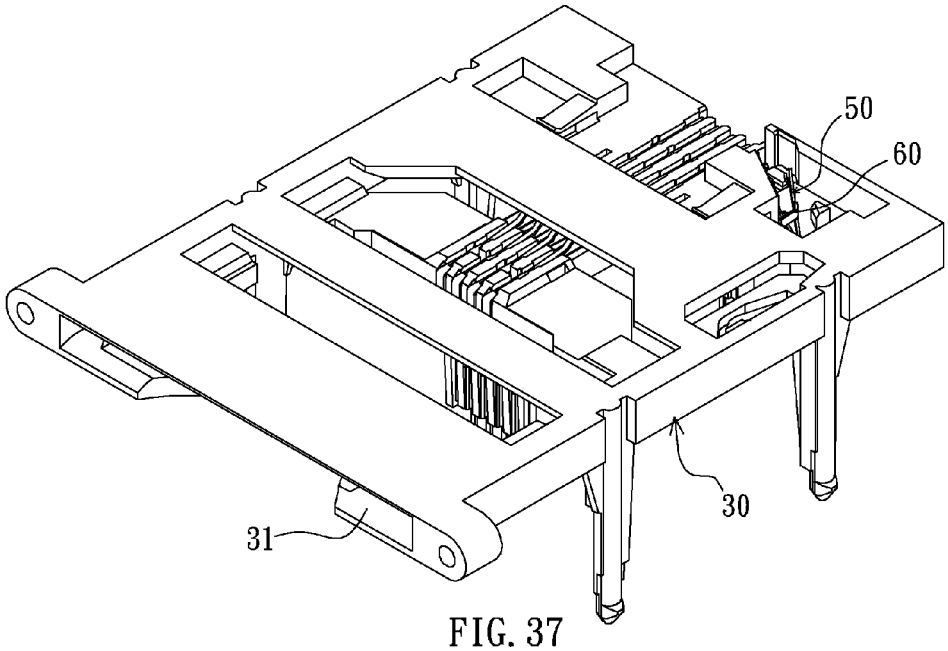
FIG. 37 is a pictorially assembled view showing the fifteenth embodiment of the invention.

As shown in FIGS. 36 and 37, the fifteenth embodiment of the invention pertains to the normally-closed embodiment and is almost the same as the twelfth embodiment except that the head section of the extension 52 of the first terminal 50 of this embodiment is a horizontal plate surface 59 connected to and perpendicular to the fixing portion 51. The tail section of the extension 52 is a longitudinal plate surface 58. The tail end of the longitudinal plate surface 58 is formed with a connection point 55, and the pushing portion 54 is higher than the connection point 55 and frontwardly projects to the front of the second terminal 60. The head section of the extension 62 of the second terminal 60 is a horizontal plate surface 69 connected to and perpendicular to the fixing portion 61. The tail section of the extension 62 is a longitudinal plate surface 68. The tail end of the longitudinal plate surface 68 is formed with a connection point 55. The connection points 55 and 65 of the first and second terminals are longitudinal and contact with each other in the front-to-rear direction.

Figure 38:
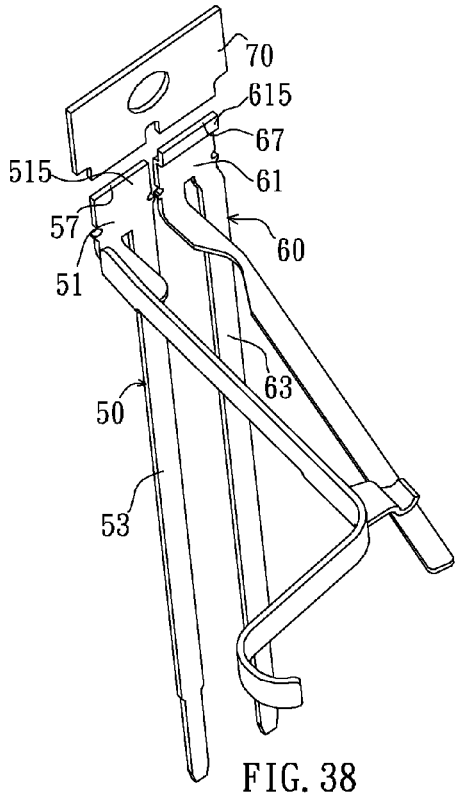
FIG. 38 is a pictorial view showing one pair of switch terminals according to a sixteenth embodiment of the invention.

As shown in FIG. 38, the sixteenth embodiment of the invention is almost the same as the fourteenth embodiment except that the top end of the fixing portion 61 of the second terminal 60 of this embodiment is bent to form a plate surface 615 connected to the material tape 70. So, the plate surfaces of the main bodies of the fixing portions 51 and 61 of the first and second terminals 50 and 60 are disposed on different planes. However, the plateless sections 57 and 67 of the top ends are flush with each other and the plate surfaces 515 and 615 of the ends are disposed on the same plane.

Figure 39:
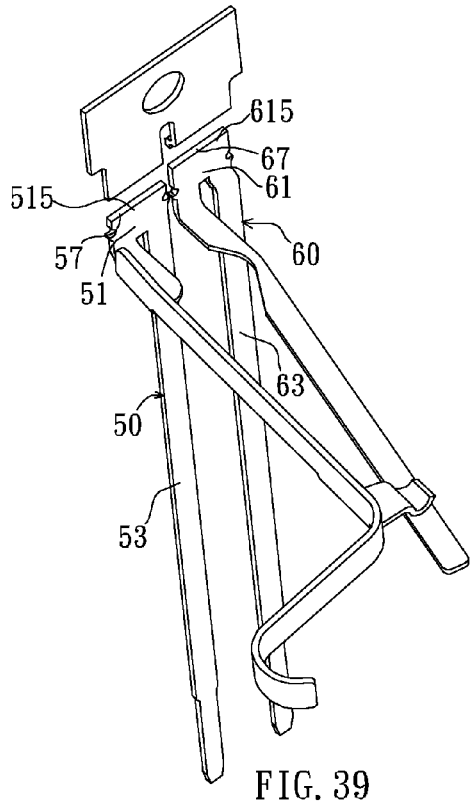
FIG. 39 is a pictorial view showing one pair of switch terminals according to a seventeenth embodiment of the invention.

As shown in FIG. 39, the seventeenth embodiment of the invention is almost the same as the fourteenth embodiment except that the overall plate surfaces of the fixing portions 51 and 61 of the first and second terminals 50 and 60 of this embodiment are disposed on different planes. The plateless sections 57 and 67 of the top ends of the fixing portions 51 and 61 are flush with each other. However, the plate surfaces 515 and 615 of the ends are disposed on different planes. So, after the first and second terminals 50 and 60 are assembled to the base, the material tape 70 cannot be directly broken by way of bending but has to be cut off.

Figure 40:
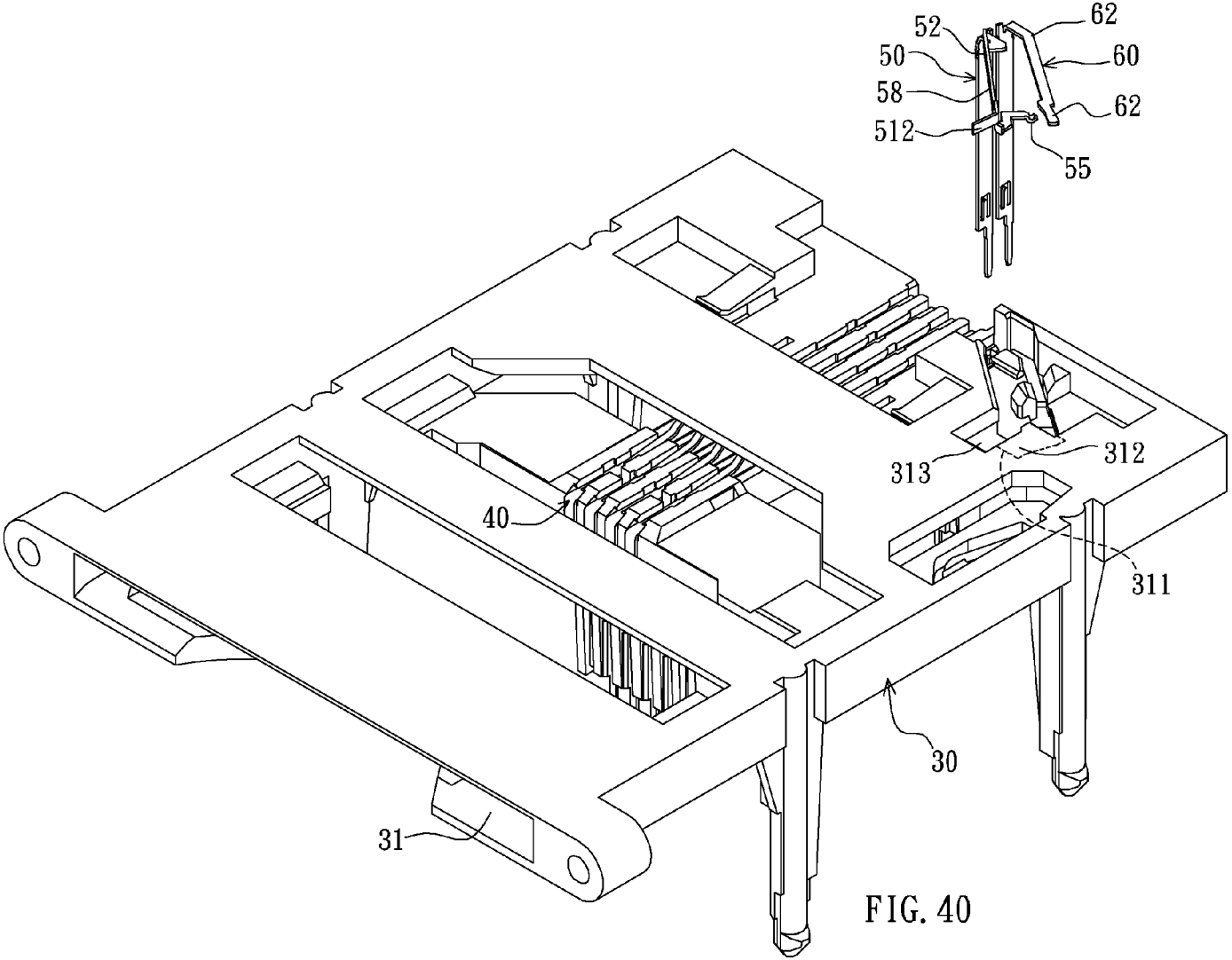
FIG. 40 is a pictorially assembled view showing an eighteenth embodiment of the invention.

As shown in FIG. 40, the eighteenth embodiment of the invention pertains to the normally-closed embodiment and is almost the same as the twelfth embodiment except that the portion of the longitudinal plate surface 58 of the extension 52 of the first terminal 50 of this embodiment near the tail end of the longitudinal plate surface 58 has a frontwardly projecting locking portion 512, and the base 30 has a front locking portion 311, an upper locking portion 312 and a notch 313.

Figure 42:
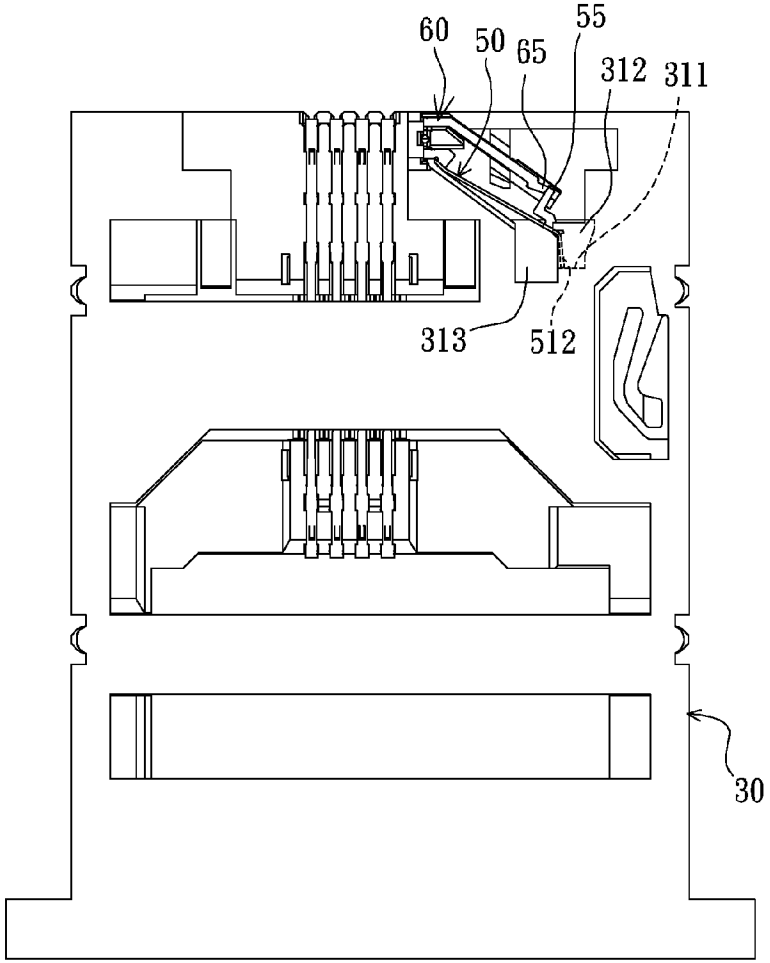
FIG. 42 is a top assembled view showing the eighteenth embodiment of the invention.
Figure 41:
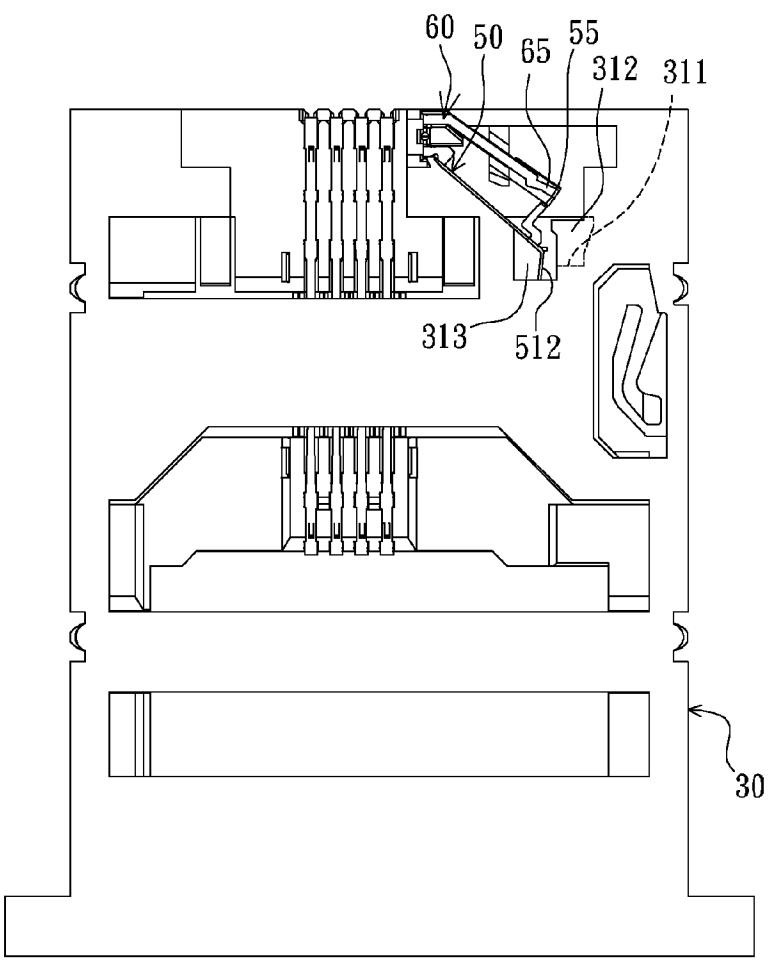
FIG. 41 is a top assembled view showing the eighteenth embodiment of the invention.

During the assembling processes, as shown in FIG. 41, the first and second terminals 50 and 60 are integrally fixed to the base 30 in a free state. At this time, the locking portion 512 of the first terminal 50 is inserted from the notch 313 of the base 30. Next, as shown in FIG. 42, when the smart card is inserted from the connection slot 31 of the base 30, the extension 52 of the first terminal 50 may be elastically moved backwards to have an excess pressure, and then lock with the front locking portion 311 of the base 30 through the locking portion 512 without being elastically moved frontwards. In addition, the locking portion 512 is locked by the upper locking portion 312. At this time, the connection point 55 of first terminal 50 pushes against the connection point 65 of the second terminal 60.

This embodiment has the following advantages.

First, although the first terminal 50 has the excess pressure pushing against the second terminal 60, the first terminal 50 is fixed to the base 30 in the free state during the assembling processes. So, the first terminal 50 can be easily and precisely assembled.

Second, the locking portion 512 of the first terminal 50 is locked by the upper locking portion 312. So, the extension 52 of the first terminal 50 cannot be biased upwards when being elastically moved. Thus, it is possible to ensure that the connection point 55 of the first terminal 50 can push against the connection point 65 of the second terminal 60 in the top-to-bottom direction.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. An electrical connector, comprising:

a base having a connection slot for accommodating an electronic element;

multiple terminals disposed on the base, each of the terminals having a contact; and one pair of switch terminals disposed on the base and comprising a first terminal and a second terminal, wherein each of the first and second terminals has a fixing portion, a pin portion and an extension, each of the fixing portions of the first and second terminals is fixed to the base, the extensions of the first and second terminals respectively have connection points corresponding to each other, the extension of the first terminal has a pushing portion, the electronic element is inserted, from a front end of the base, into the connection slot to push the pushing portion to make the extension of the first terminal be elastically moved to touch the pair of switch terminals, wherein:

the first and second terminals are made of a metal sheet by way of pressing, plate surfaces of the fixing portions of the first and second terminals are arranged in parallel or on the same plane and fixed to the base, and the plate surfaces of the fixing portions of the first and second terminals do not overlap with each other; and one end surface or the other end surface of each of the fixing portions of the first and second terminals connected to the pin portion has a plateless section, and the first and second terminals do not overlap with each other when the plateless sections of first ends of the fixing portions of the first and second terminals are flush with each other and the first and second terminals are developed on the same plane.

2. The electrical connector according to claim 1, wherein the fixing portions of the first and second terminals are disposed on the same plane, the plateless sections of first ends of the fixing portions of the first and second terminals are flush with each other and the plate surfaces of the first ends are disposed on the same plane.

3. An electrical connector, comprising:

a base having a connection slot for accommodating an electronic element;

multiple terminals disposed on the base, each of the terminals having a contact; and one pair of switch terminals disposed on the base and comprising a first terminal and a second terminal, wherein each of the first and second terminals has a fixing portion, a pin portion and an extension, each of the fixing portions of the first and second terminals is fixed to the base, the extensions of the first and second terminals respectively have connection points corresponding to each other, the extension of the first terminal has a pushing portion, the electronic element is inserted, from a front end of the base, into the connection slot to push the pushing portion to make the extension of the first terminal be elastically moved to touch the pair of switch terminals, wherein:

the first and second terminals are made of a metal sheet by way of pressing, plate surfaces of the fixing portions of the first and second terminals are arranged in parallel or on the same plane and fixed to the base, and the plate surfaces of the fixing portions of the first and second terminals do not overlap with each other; and the extensions and the fixing portions of the first and second terminals are connected to each other and have the plate surfaces perpendicular to each other, the base has two longitudinal slots, the plate surfaces of the fixing portions of the first and second terminals are longitudinally fixed to two longitudinal slots of the base, the extensions of the first and second terminals have horizontal plate surfaces extending and facing the base, a portion of the first terminal near a tail end of the first terminal has the pushing portion and the connection point, and a portion of the extension of the second terminal near a tail end of the second terminal has the connection point.

4. The electrical connector according to claim 1, wherein the pair of switch terminals are disposed near a rear end of the base, the electronic element is a smart card, the smart card has two rows of connection points aligned in a front-to-rear direction, the multiple terminals are arranged in two rows, the contacts of the two rows of terminals correspond to each other in a front-to-rear manner, and when the smart card is inserted into the connection slot, the two rows of connection points of the smart card aligned in a front-to-rear direction are electrically connected to the contacts of the two rows of terminals.

5. The electrical connector according to claim 1, wherein the connection points of the first and second terminals are separated, and when the pushing portion of the first terminal is pushed by the electronic element, the connection points of the first and second terminals are in a contacting state.

6. The electrical connector according to claim 1, wherein the connection points of the first and second terminals elastically contact with each other, and when the pushing portion of the first terminal is pushed by the electronic element, the connection points of the first and second terminals are in a separated state.

7. The electrical connector according to claim 1, wherein the extension of the first terminal further has a longitudinal plate surface, the longitudinal plate surface has the pushing portion, and the extension of the first terminal is elastically moved in a front-to-rear direction when the electronic element pushes the pushing portion.

8. The electrical connector according to claim 3, wherein base has a switch terminal slot with an inlet facing downwards, the two longitudinal slots are disposed on a bottom end of the base with an insert port facing downwards, the switch terminal slot has an opening communicating with the connection slot, and the fixing portions of the first and second terminals engages with the two longitudinal slots of the base from bottom to top, so that the first and second terminals are positioned in the switch terminal slot, and the pushing portion of the first terminal extends from the opening to the connection slot.

9. The electrical connector according to claim 1, wherein the extensions of the first and second terminals have longitudinal plate surfaces, the longitudinal plate surface of the extension of the first terminal has the pushing portion and the connection point, the longitudinal plate surface of the extension of the second terminal has the connection point, and the connection points of the first and second terminals are longitudinal and correspond to each other in a front-to-rear direction.

10. The electrical connector according to claim 1, wherein an inserting direction of the electronic element is parallel to the plate surfaces of the fixing portions of the first and second terminals.

11. The electrical connector according to claim 1, wherein the connection points of the first and second terminals contact with each other in a top-to-bottom direction, one of the connection points faces upwards and the other of the connection points faces downwards, the extension of the first terminal may be elastically moved in a front-to-rear direction, and the connection point of the first terminal may be moved in the front-to-rear direction to contact with or separate from the connection point of the second terminal in the top-to-bottom direction when the extension of the first terminal is elastically moved in the front-to-rear direction.

12. The electrical connector according to claim 1, wherein the extension of the first terminal has a projecting locking portion, the base has a front locking portion, and after the first and second terminals are fixed to the base and when the electronic element is inserted from the connection slot of the base, the extension of the first terminal may be elastically moved backwards to have an excess pressure, and locked with the front locking portion of the base through the projecting locking portion without being elastically moved frontwards.

13. The electrical connector according to claim 12, wherein the base further has an upper locking portion, and the upper locking portion locks with the locking portion of the first terminal so that the extension of the first terminal cannot be biased upwards.

14. The electrical connector according to claim 12, wherein the locking portion of the first terminal projects frontwards and is disposed near a tail end of the extension, the base has a notch, and when the first and second terminals are assembled to the base, the locking portion of the first terminal may be inserted from the notch.

15. The electrical connector according to claim 1, wherein the base has a projection urging the extension of the first terminal towards the second terminal, so that the extension of the first terminal has flexibility of an excess pressure.

16. A pair of switch terminals of an electrical connector, wherein the pair of switch terminals is formed by pressing the same metal sheet, the pair of switch terminals comprising:

a material tape;

a first terminal having a fixing portion, a pin portion and an extension, wherein one end or the other end of the fixing portion connected to the pin portion is connected to the material tape, and each of the extensions has a pushing portion and a connection point; and a second terminal having a fixing portion, a pin portion and an extension, wherein one end or the other end of the fixing portion connected to the pin portion is connected to the material tape, each of the extensions has a connection point corresponding to the connection point of the first terminal, and the first and second terminals do not overlap with each other when the first and second terminals are developed on the same plane.

17. The pair of switch terminals according to claim 16, wherein plate surfaces of the fixing portions of the first and second terminals are longitudinal, the extensions of the first and second terminals have horizontal plate surfaces connected to and perpendicular to the fixing portions, a portion of the extension of the first terminal near a tail end of the extension of the first terminal has the pushing portion and the connection point, and a portion of the extension of the second terminal near a tail end of the extension of the second terminal has the connection point.

18. The pair of switch terminals according to claim 16, wherein the extension of the first terminal further has a longitudinal plate surface, the longitudinal plate surface has the pushing portion, and the extension of the first terminal is elastically moved in a front-to-rear direction when the pushing portion is forced.

19. The pair of switch terminals according to claim 16, wherein the extensions of the first and second terminals have longitudinal plate surfaces, the longitudinal plate surface of the extension of the first terminal has the pushing portion and the connection point, the longitudinal plate surface of the extension of the second terminal has the connection point, and the connection points of the first and second terminals longitudinally correspond to each other in a front-to-rear direction.

* * * * *